US007195672B2

(12) United States Patent
Ghilardi

(10) Patent No.: US 7,195,672 B2
(45) Date of Patent: Mar. 27, 2007

(54) PREP PAINT POST

(76) Inventor: Pierangelo Ghilardi, 833 Romany Rd., Charlotte, NC (US) 28203

( * ) Notice: Subject to any disclaimer, the term of this patent is extended or adjusted under 35 U.S.C. 154(b) by 0 days.

(21) Appl. No.: 10/999,324

(22) Filed: Nov. 30, 2004

(65) Prior Publication Data

US 2005/0115497 A1 Jun. 2, 2005

Related U.S. Application Data

(60) Provisional application No. 60/525,974, filed on Dec. 1, 2003.

(51) Int. Cl.
*B05B 15/12* (2006.01)

(52) U.S. Cl. ..... 118/326; 118/DIG. 7; 454/50; 454/53; 55/DIG. 46

(58) Field of Classification Search ..... 118/326, 118/309, DIG. 7; 454/50–53; 55/DIG. 46
See application file for complete search history.

(56) References Cited

U.S. PATENT DOCUMENTS 3,066,720 A * 12/1962 Fontaine ..... 28/143
5,113,600 A * 5/1992 Telchuk ..... 34/90
5,766,355 A * 6/1998 Josefsson et al. ..... 118/326
6,162,270 A * 12/2000 Nystrom et al. ..... 55/385.2
6,264,547 B1 * 7/2001 Walti ..... 454/52

* cited by examiner

*Primary Examiner*—Yewebdar Tadesse

(57) ABSTRACT

This is a working post to be utilized for all those functions where air circulation is suggested or required. It is comprised of three main parts: an airflow generator, which is connected to an air filtering hollow floor and to an air and light filtering hollow roof. The working area is the space between the floor and the roof. The airflow generator contains only one motor that powers simultaneously two fans. It does not need a floor pit nor wall plenums to achieve an extremely efficient, powerful and uniform downdraft air circulation in the working area, and to allow the attainment of a superior finish of the object while providing a clean environment for the operator. It is also simple to operate, cost effective, space effective and energy efficient.

12 Claims, 7 Drawing Sheets

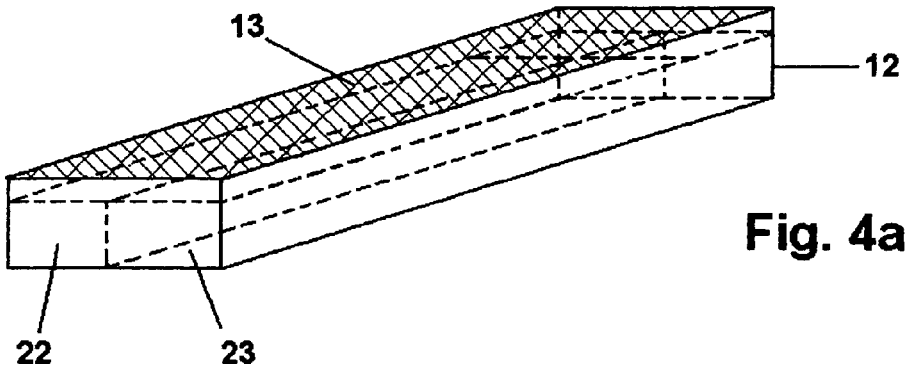
Fig. 4a
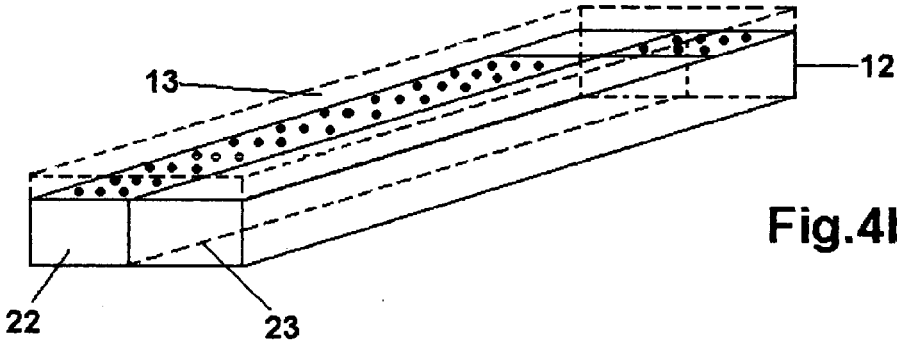
Fig.4b
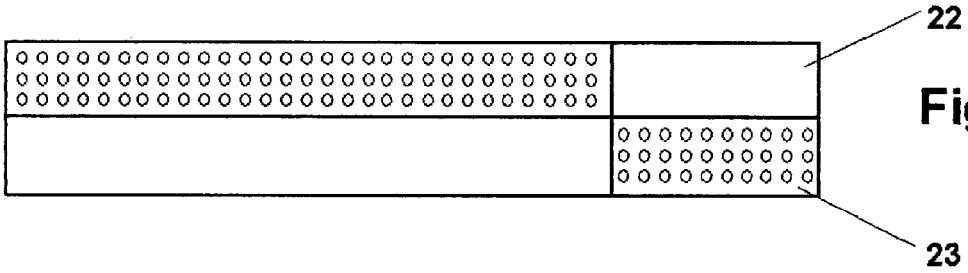
Fig.4c
Fig. 4d
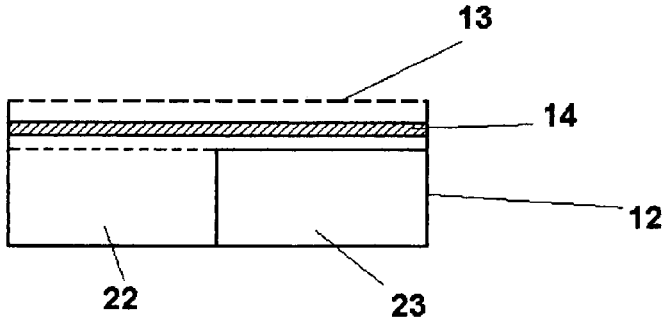

PREP PAINT POST

This application claims the benefits of U.S. provisional application No. 60/525,974 filed on Dec. 1, 2003.

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates to a novel system of utility in the general field of spray booths, prep stations and mix rooms.

It is well known that while conducting sanding, mixing, preparation, spraying, and/or other operations on an object, considerable quantities of dust, fumes, particulate emissions, and/or other unwanted dangerous evaporants are generated. The best way to remove those unwanted emissions is by flowing air through the working area.

The simplest technique is the horizontal flow or cross-draft. This method, although relatively very simple and inexpensive to implement, moves any unwanted part along the length of the object before expelling it, thus exposing the worker to hazardous particles and making it very difficult to attain a superior finish of the object.

Another configuration is the vertical flow or downdraft. Most prior art uses this method which gives the best results in terms of finishing and of working environment for the operator. With this technique the air flows from the ceiling to the floor of the booth, the prep station or the mix room. In conventional prior art, in order to exhaust the air, a pit is incorporated into the floor, or plenums are incorporated into the walls. Such pits and plenums can be very expensive and require a significant amount of space. Conventional prior art also often requires separate modules containing heaters, fans, filters to be positioned next to the main spray booth, prep station or mix room area. These too can be very expensive and require a significant amount of space.

The present invention provides a system that works as prep station, mix room and spray booth; it allows a world class finish of the object and provides a clean environment for the operator; it is simple to operate, cost effective, space effective and energy efficient.

U.S. PATENT DOCUMENTS—REFERENCES CITED

Not Applicable

FOREIGN PATENT DOCUMENTS—REFERENCES CITED

Not Applicable

BRIEF SUMMARY OF THE INVENTION

This is a complete system that works as prep station, paint booth, and mix room, granting optimal working conditions for sanding, painting and fast drying of fully or partially assembled items including wood, plastic, marble, granite, sandstone, stone and metal parts.

The system is comprised of three main parts: a compact airflow generator, which is connected to an air filtering hollow floor and to an air and light filtering hollow roof. The working area is the space between the floor and the roof.

The airflow generator is comprised of: three compartments for the air flow; a burner; a motor that powers two fans; a gear motor that powers two airlocks; and a free airlock.

The air filtering hollow floor is comprised of a plurality of elongated hollow tubular pieces that are positioned beside each other, perpendicularly to the air flow generator.

The plenum roof is connected to and supported by the airflow generator and has the dual purpose of simultaneously filtering the air and the light.

BRIEF DESCRIPTION OF THE SEVERAL VIEWS OF THE DRAWING

FIG. 4*a* shows a perspective inside view of one elongated hollow tubular piece.

FIG. 4*b* shows a perspective inside view of one elongated hollow tubular piece.

FIG. 4*c* shows a top view of the elongated hollow tubular piece chambers.

FIG. 4*d* shows a sectional view of one elongated hollow tubular piece.

Figure 1:
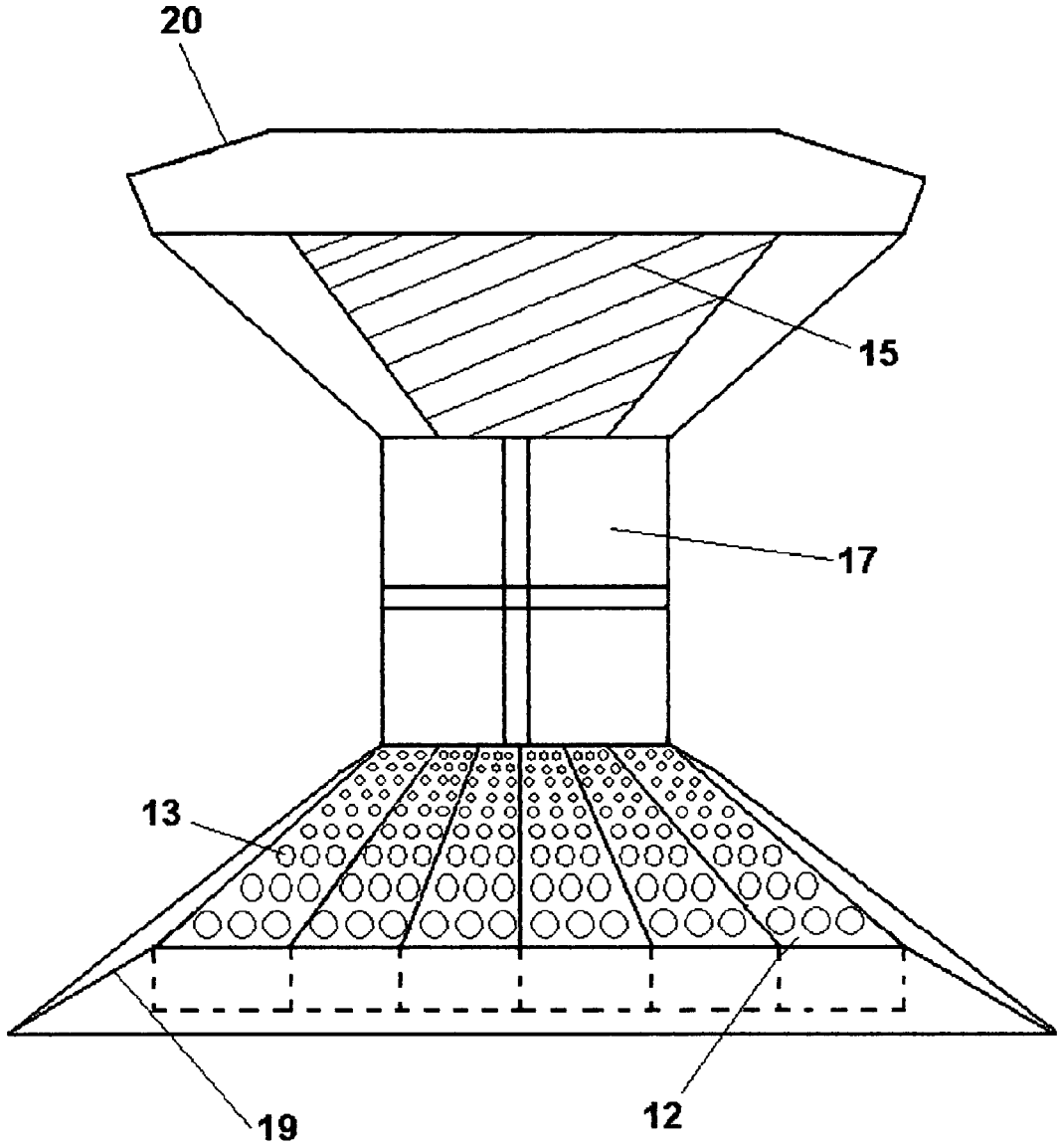
FIG. 1 shows a front view of the prep paint post.

| DRAWING REFERENCE NUMERALS | |
|---|---|
| 1 airflow compartment | 2 airflow compartment |
| 3 airflow compartment | 4 burner |
| 5 motor | 6 fan |
| 7 fan | 8 gear motor |
| 9 airlock | 10 airlock |
| 11 airlock | 12 elongated hollow tubular piece |
| 13 grate | 14 air filter |
| 15 air and light filter | 16 light |
| 17 airflow generator | 18 holding bars |
| 19 ramp | 20 plenum roof |
| 21 curtain | 22 chamber |
| 23 chamber | 24 bar |

DETAILED DESCRIPTION OF THE INVENTION

The present invention relates to a system of utility in the field of prep stations, spray booths, mix rooms, and all those functions where air circulation is suggested or required.

The present invention provides a system which is easier to use for the intended purpose.

The present invention also reduces the number of parts needed in order to lower costs and reduce the total volume of a paint booth or prep station, thus allowing the realization of an inexpensive, high-performing unit.

The present invention also provides a simpler, more efficient combination of parts which allows the realization of a compact airflow generator and a thin floor that accepts and filters exhaust air without requiring the construction of a pit.

The present invention also allows for a better, more controlled air circulation that maintains an even velocity, increases work area safety and improves product finishing quality.

The present invention also provides a superior, more uniform light.

The present invention further provides a machine which can be easily installed.

All these improvements, and others, of the present invention will become clear to those skilled in the art, after carefully studying the following detailed description along with the annexed drawings where the preferred embodiments of the present invention are shown only for purposes of illustration.

FIG. 1 shows a front view of the prep paint post which is comprised of three main parts: an air flow generator 17 which is connected to an air and light filtering plenum roof 20, and to an air filtering floor formed by a plurality of elongated hollow tubular pieces 12. The working area is the space between the plenum roof 20 and the elongated tubular pieces 12. The elongated tubular pieces 12 are encircled by a ramp 19 whose purpose is to ease the access to the working area.

Figure 1A:
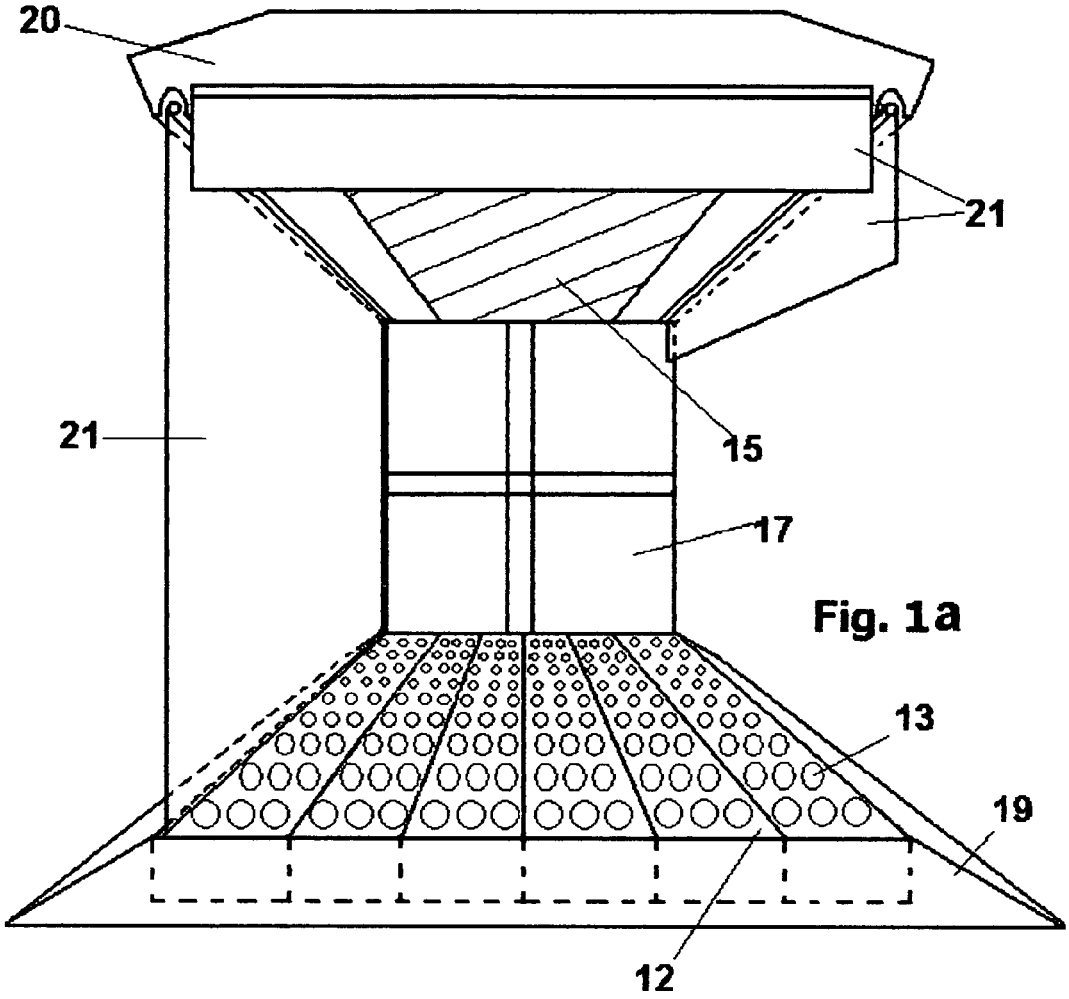
FIG. 1*a* shows a front view of the prep paint post with curtains.

FIG. 1*a* shows a front view of the prep paint post, wherein curtains 21 are installed on the sides and on the front of plenum roof 20 in order to allow privacy during working and to avoid heat exchange.

Figure 1B:
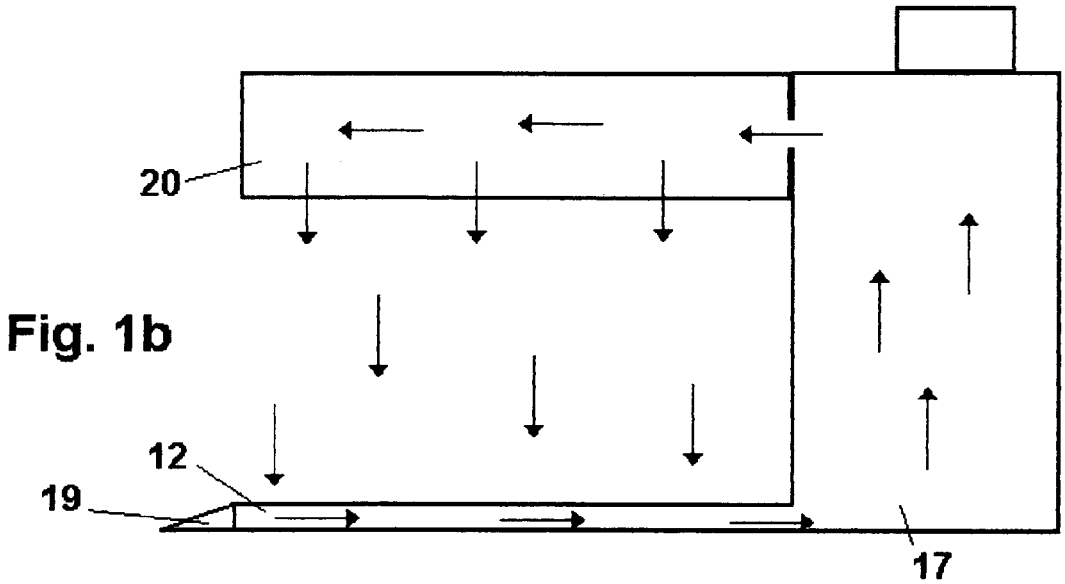
FIG. 1*b* shows a side view of the prep pain post with airflow direction.

FIG. 1*b* shows a side view of the prep paint post with airflow direction. The air is blown from the airflow generator 17 into the plenum roof 20, diffused through the working area and further sucked back into the airflow generator 17 though the elongated tubular pieces 12.

Figure 2:
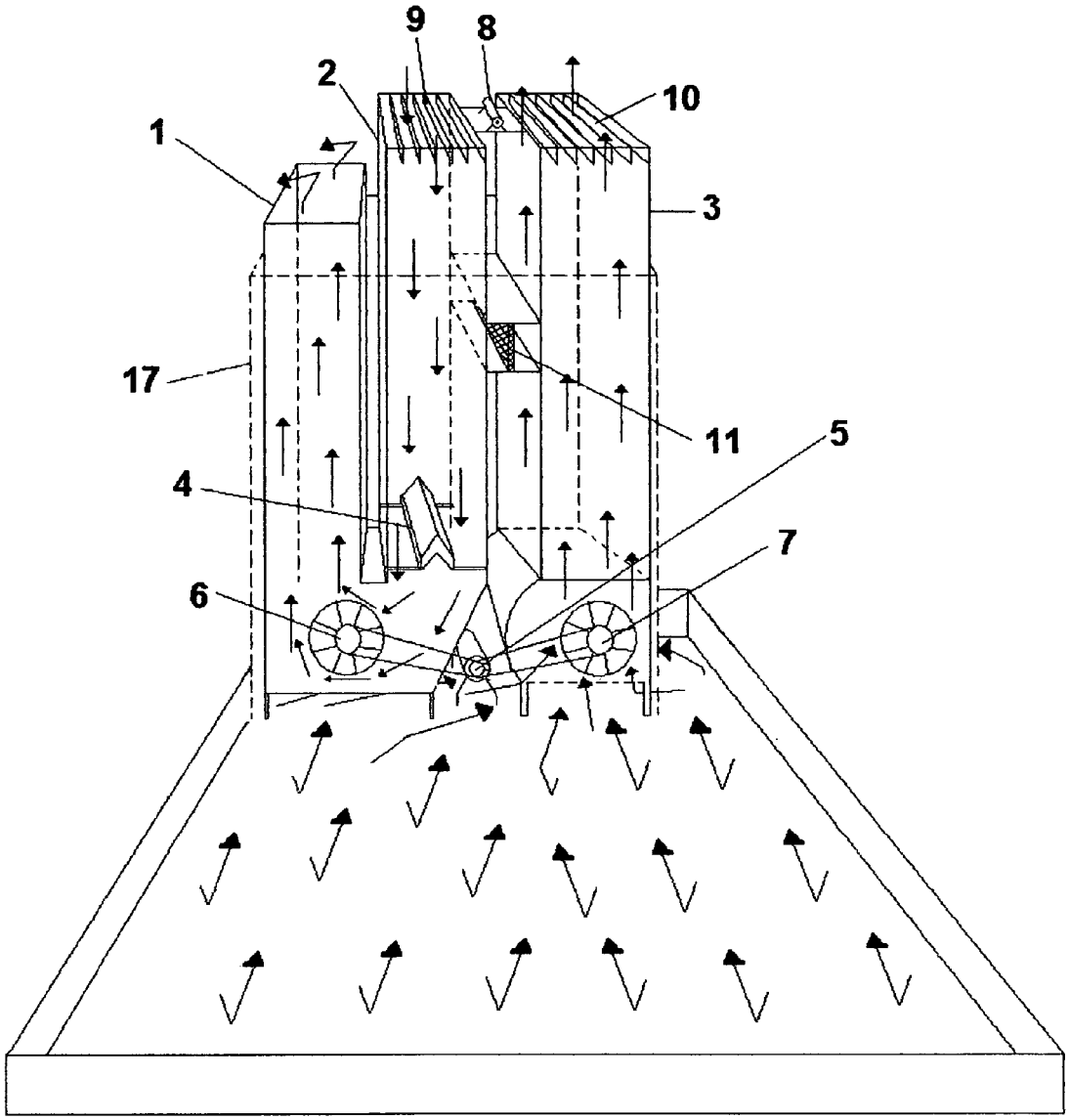
FIG. 2 shows the compact airflow generator in position for air circulation.

FIG. 2 shows the compact airflow generator 17 in position for air circulation. A gear motor 8 operates airlock 9 and airlock 10 which are open, while free airlock 11 is closed. Clean air is sucked in by fan 6 though compartment 2. The air is optionally warmed by burner 4 and blown into plenum roof 20 through compartment 1. The air is then sucked in through the filtering hollow floor by fan 7 and blown outside of the system through compartment 3.

Figure 3:
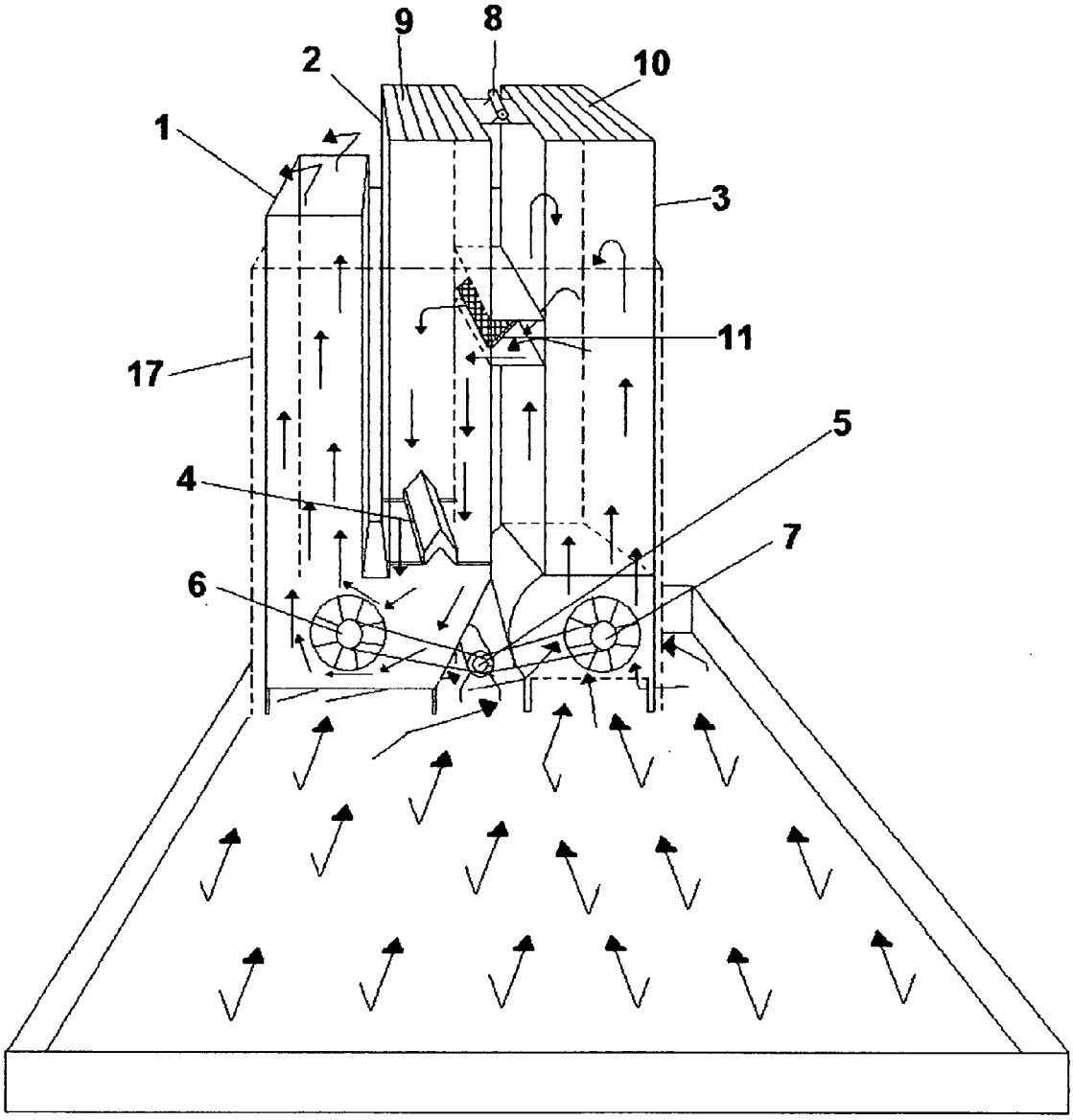
FIG. 3 shows the compact airflow generator in position for air recirculation.

FIG. 3 shows the compact airflow generator in position for air recirculation. A gear motor 8 operates airlock 9 and airlock 10 which are closed, while free airlock 11 is open. Clean air is sucked in by fan 6 though compartment 2. The air is warmed by burner 4 and blown into plenum roof 20 through compartment 1. The warm air is then sucked in through the filtering hollow floor by fan 7 and blown back into the system though compartment 3 and airlock 11.

Figure 4:
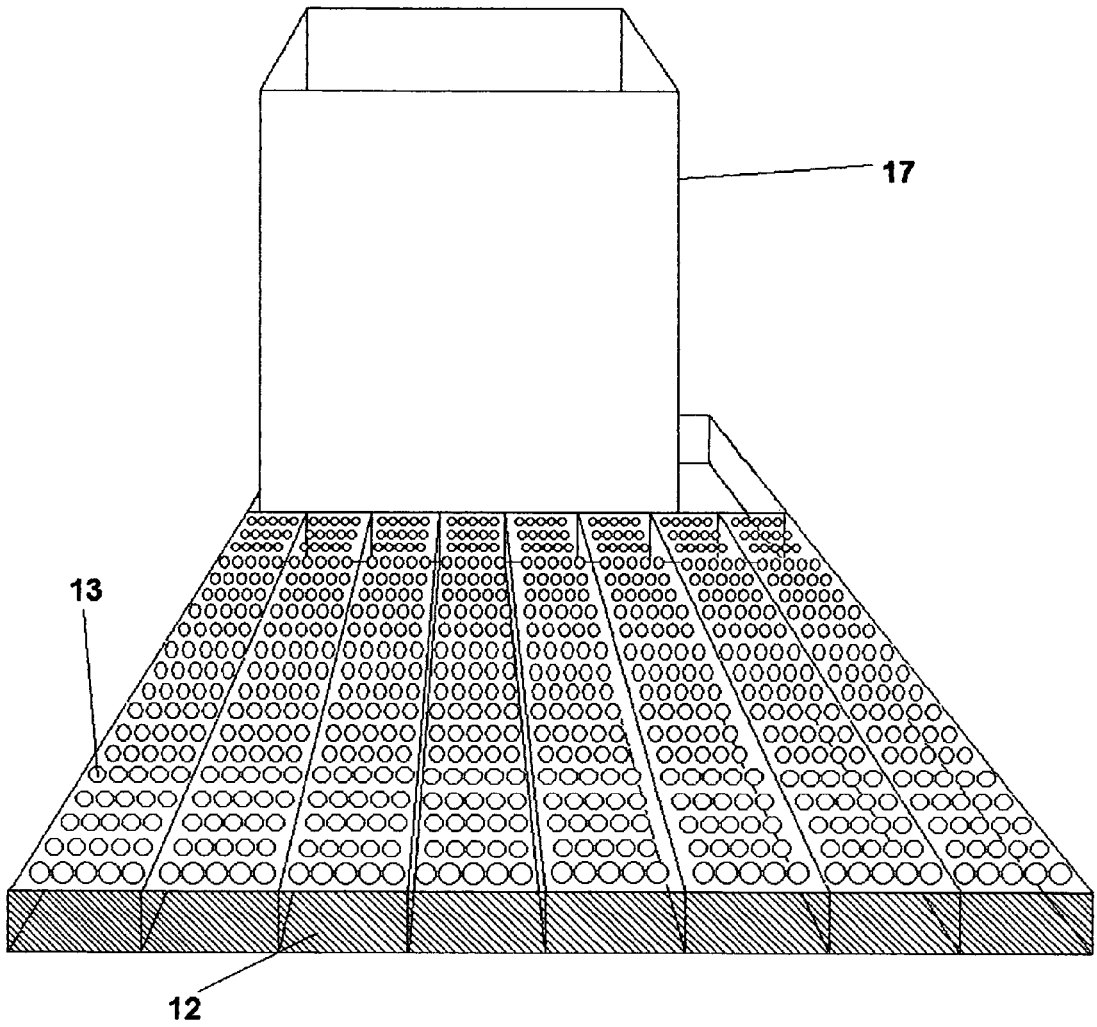
FIG. 4 shows a perspective view of the floor made of elongated hollow tubular pieces.

FIG. 4 shows the air filtering hollow floor comprised of a plurality of elongated hollow tubular pieces 12 that are positioned beside each other perpendicularly to the airflow generator 17. The elongated hollow tubular pieces 12 have an open end on the side of the airflow generator 17 and a closed end on the opposite side. The elongated hollow tubular pieces 12 have a grate 13 as their upper surface that allows the air to enter their canal. The elongated hollow tubular pieces 12 have an ideal height between 14 and 18 cm and an ideal width between 45 and 50 cm, while their length may vary according to the desired length of the working area. The elongated hollow tubular pieces 12 have three main purposes: support the piece of material that is being worked; filter the air, and increase the velocity of the air while conveying it back to the airflow generator 17.

FIG. 4*a* shows a perspective inside view of one elongated hollow tubular piece 12 containing chamber 23 and chamber 24 of equal dimensions, and having a grate 13 as its upper surface.

FIG. 4*b* shows a perspective inside view of one elongated hollow tubular piece 12, wherein inside chambers 22 and 23 have alternate perforation on their upper surface. In particular, chamber 22 is perforated along most of its upper surface and has a whole upper surface along the rest of its length, while chamber 23 has a whole upper surface along most of its length and is perforated along the rest of its upper surface. This double channel with alternate perforation design inside the elongated tubular pieces 12 allows for more uniform air suction and eliminates air load loss.

FIG. 4*c* shows a top view of the elongated hollow tubular chambers 22 and 23, illustrating the alternate perforation design of their upper surface.

FIG. 4*d* shows a sectional view of one elongated hollow tubular piece 12 that contains two chambers, 22 and 23, and the upper surface of which is a grate 13. An air filter 14 is positioned in between the top side of the two chambers 22 and 23 and the grate 13.

Figure 5:
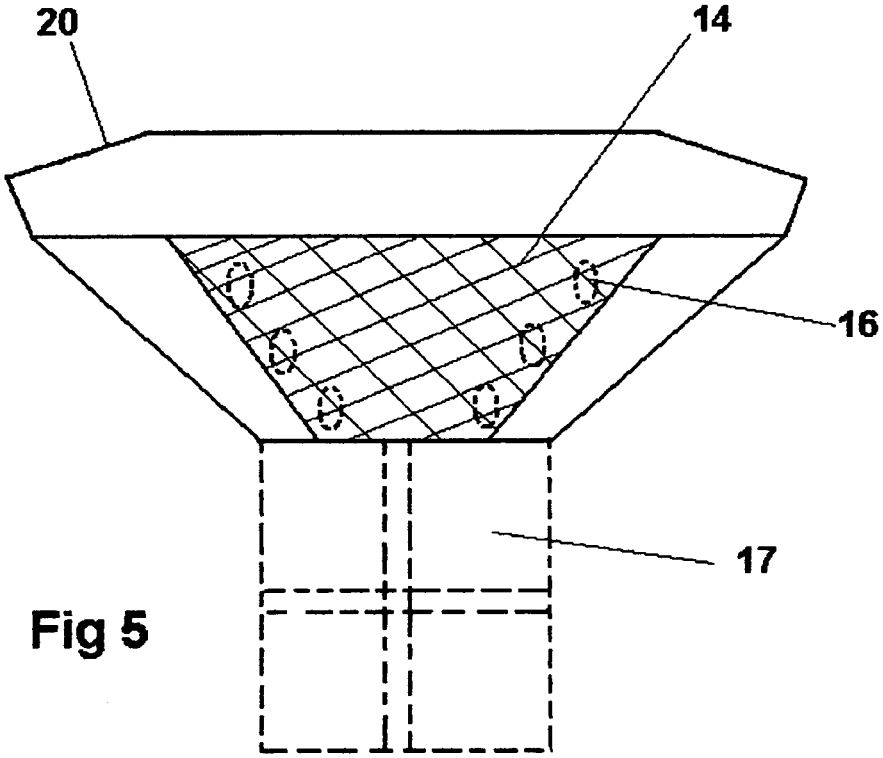
FIG. 5 shows the plenum roof with inside lighting.

FIG. 5 shows the plenum roof 20 with lights 16 placed inside it. The bottom surface of the plenum roof 20 is an air and light filter 16.

Figure 5A:
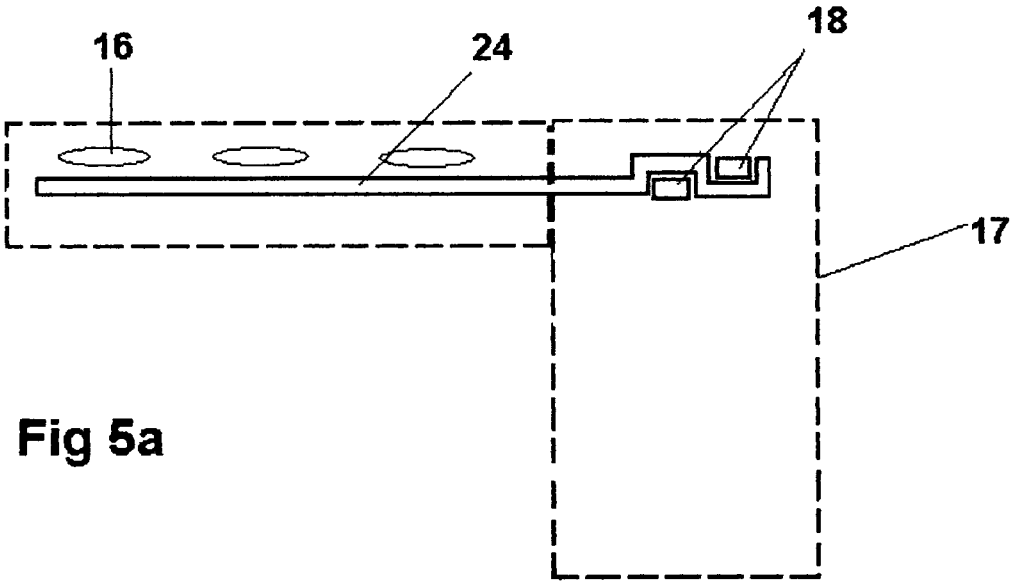
FIG. 5*a* shows details of the connection of the plenum to the compact airflow generator.

FIG. 5*a* shows a side view of the plenum roof 20 with the lights 16 positioned in its interior part. It also illustrates how the plenum roof 20 is connected to the airflow generator 17 by means of bar 24 hooked to holding bars 18.

It should now be clear to those skilled in the art that using only one motor to power two fans will reduce the consumption of power, the number of parts needed and it will reduce the total volume of an airflow generator allowing for a more compact design and a better, more controlled air circulation.

Moreover, a compact airflow generator allows the operators to switch from the air exhaustion to the air recirculation mode without turning off the motor.

Additionally, having one single motor that powers the suction and the blowing fan, will maintain an even velocity or the air circulation in the system.

Furthermore, using elongated tubular pieces to build the floor will increase the velocity of the air reducing the amount of space needed for air circulation, thus allowing for a very low structure and eliminating the need for the construction of a pit in the floor or plenums in the walls will consistently reduce the space needed and the cost of installation.

In addition, using a fewer number of parts will reduce the chances of breakage and the installation time.

Also, having a superior, filtered, uniform light gives the operator the best working conditions.

Although the description above contains many specificities, these should not be construed as limiting the scope of the invention, but merely to provide illustrations of some of the presently preferred embodiments of this invention. Various other embodiments and ramifications are possible within its scope. Thus the scope of the invention should be determined by the appended claims and their legal equivalents, rather than by the examples given.

I claim:

1. In a working post with air circulation comprising an airflow generator which is connected to a plenum roof and a hollow floor, a working area being the space between said hollow floor and said plenum roof, the improvement comprises:

a. an airflow generator comprising:

(1) three compartments, wherein a first compartment is connected to a second compartment and to said plenum roof, said second compartment leads outside said airflow generator and is connected to said first compartment and to a third compartment, said third compartment leads outside said airflow generator and is connected to said hollow floor and to said second compartment, (2) two fans, wherein said first fan is positioned inside said connection of said first compartment and said second compartment, and said second fan is positioned inside said third compartment, (3) one motor that simultaneously powers said first fan and said second fan and is positioned in between said first fan and said second fan, (4) three airlocks, wherein a first airlock is positioned on top of said second compartment, a second airlock is positioned on top of said third compartment, a third airlock that is positioned inside said connection of said second compartment and said third compartment, (5) one gear motor that simultaneously operates said first airlock and said second airlock, b. a plenum roof that is connected to and supported by said airflow generator, containing inside its hollow part at least one source of light, and having a filter means as its lower surface, c. an air filtering hollow floor comprising a plurality of elongated tubular pieces positioned beside each other perpendicularly to said airflow generator, each of them having a perforated upper surface and, an open end on the side of said airflow generator and a dosed end on the opposite side.

2. A working post as described in claim 1, wherein said airflow generator comprises a heater that is positioned inside said second compartment.

3. A working post as described in claim 1, wherein at least one air filter is positioned inside said elongated tubular pieces.

4. A working post as described in claim 1, wherein each of said elongated tubular pieces contains at least two chambers with alternate perforations on their upper surface.

5. A working post as described in claim 1, wherein each of said elongated tubular pieces contains at least two chambers and at least one air filter.

6. A working post as described in claim 1, wherein said plenum roof has lights positioned outside its hollow part.

7. A working post as described in claim 1, wherein said plenum roof has curtains installed on its sides and on its front.

8. A working post with air circulation comprising an airflow generator which is connected to a plenum roof and a hollow floor, a working area being the space between said hollow floor and said plenum roof, wherein said airflow generator comprises:

a. three compartments, wherein a first compartment is connected to a second compartment and to said plenum roof, said second compartment leads outside said airflow generator and is connected to said first compartment and to a third compartment, said third compartment leads outside said airflow generator and is connected to said hollow floor and to said second compartment, b. two fans, wherein said first fan is positioned inside said connection of said first compartment and said second compartment, and said second fan is positioned inside said third compartment, c. one motor that simultaneously powers said first fan and said second fan and is positioned in between said first fan and said second fan d. three airlocks, wherein a first airlock is positioned on top of said second compartment, a second airlock is positioned on top of said third compartment, a third airlock that is positioned inside said connection of said second compartment and said third compartment, e. one gear motor that simultaneously operates said first airlock and said second airlock.

9. A working post as described in claim 8, wherein said airflow generator comprises a heater that is positioned inside said second compartment.

10. A working post with an air circulation comprising an airflow generator which is connected to a plenum roof and a hollow floor, a working area being the space between said hollow floor and said plenum roof, wherein said hollow floor is comprised of a plurality of elongated hollow tubular pieces, having perforations as their upper surface, positioned beside each other perpendicularly to said airflow generator, and having an open end on the side of said airflow generator and a closed end on the opposite side wherein each of said elongated tubular pieces contains at least two chambers with alternate perforations on their upper surface.

11. A working post as described in claim 10, wherein at least one filter is positioned inside said elongated hollow tubular pieces.

12. A working post as described in claim 10, wherein each of said elongated tubular pieces contains at least two chambers and at least one air filter.

* * * * *